US005700187A

United States Patent [19]

Balbi

[11] Patent Number: 5,700,187

[45] Date of Patent: Dec. 23, 1997

[54] TOOL TO STOPPER AND ABRADE CONCAVE AND CONVEX SURFACES

[76] Inventor: Gaetano Balbi, Via R. Quartini n. 5/4, I-16019 Ronco Scrivia-Genova, Italy

[21] Appl. No.: 721,102

[22] Filed: Sep. 26, 1996

[51] Int. Cl.[6] ..... B24D 17/00

[52] U.S. Cl. ..... 451/495; 451/499; 451/501; 451/496

[58] Field of Search ..... 451/495, 499, 451/501, 496

[56] References Cited

U.S. PATENT DOCUMENTS

| | | | |
|---|---|---|---|
| 3,123,947 | 3/1964 | Rawley | 451/495 |
| 4,823,515 | 4/1989 | Blome | 451/495 |
| 4,944,128 | 7/1990 | Reiter | 451/495 |
| 5,387,251 | 2/1995 | Rouse | 451/495 |

*Primary Examiner*—Robert A. Rose
*Assistant Examiner*—George Nguyen
*Attorney, Agent, or Firm*—Graham & James LLP

[57] ABSTRACT

This tool consists of a deformable plastic supporting base plate (1) bearing on its lower outer surface the stopper and abrasive materials, it further includes two upwards slanting interconnecting elements (2) in indeformable material or plates having a low deformability index, the lower end of these elements (2) being fastened to the transverse legs of the supporting base (1), two rotating cross journal (6) being secured to the upper end of the interconnecting elements (2), each journal (6) featuring at both ends threaded holes (9') as well as a longitudinal central boring (3', 4') with opposed threads, a screw (3, 4) half of which is left-threaded and the other half is right-threaded separated by a small control wheel (5), a guide (8) bearing the handgrips (10), provided with a central hole (11) through which the control wheel (5) is protruding, lateral slots (12) through which to fit the locking screws (9) into the borings (9') in both ends of the journals (6). The supporting base may be adjusted to the shape of the surface to be treated by changing the distance (L) between the journals (6) and the height (H1, H2) of the journals (6) above the supporting base (1).

6 Claims, 2 Drawing Sheets

TOOL TO STOPPER AND ABRADE CONCAVE AND CONVEX SURFACES

FIELD OF THE INVENTION

This invention covers a tool to stopper and abrade concave and convex surfaces of any kind and nature whatsoever. This tool is in particular, but not exclusively, used in coachbuilders' and Repair Shops to recommission damaged and distorted surfaces.

BACKGROUND OF THE INVENTION

At present, the surfaces of car bodies or of other products or construction work are repaired by remodeling them as best one can. These surfaces are then hard stopped, finished by abrasion and paintcoated. Stoppering and abrasion are usually by hand and involve great difficulties since these operations have to be performed on flat as well as on curved—concave or convex—surfaces having a constant or variable bending radius. This is the reason why such repair is often not workmanlike performed.

SUMMARY OF THE INVENTION

This invention has the objective to provide an adjustable tool consisting of a basic support bearing the stopper material and the subsequent abrasion product, deformable by fine adjustment according to need and to the shape of the surface to be treated.

This tool essentially consists of a—usually rectangular shaped —elastic deformable plate, forming the supporting base; the shorter sides of this rectangular support are the transverse legs, whereas the longer sides are the longitudinal legs of this rectangle. Two interconnecting elements in indeformable or low-elasticity plate material are rigidly fixed at both transverse ends of the above mentioned supporting plate and are slanting upwards. A cross journal featuring at both ends threaded holes with lateral axis and a through hole with longitudinal axis in the center, is secured at the upper free end of the above mentioned interconnecting elements. The threads of the central borings are opposed and may be for instance, left and right-handed.

A lengthwise screw, half of which has a left-handed and the other half a right-handed thread, meshes with these central screw threads and the opposed screw threads are separated by a control knob or small wheel.

The upper part of the tool features a guide supporting the handgrips provided with lateral slots through which the lock screws are fitted in the holes bored in both ends of the aforesaid journal, while a central hole in the handgrip permits the control wheel to protrude through the upper part of the guide.

By changing the reciprocal distance L between the two cross journals and keeping unaltered the spacing (height) H1, H2 between the transverse journals and the supporting base, the latter may be given a concave or convex shape having a constant bending radius. But if H1 and H2 have not the same height, the concave or convex shape of the base will have a variable curvature, not assimilable with a cylindrical surface. This makes it possible exactly to adjust the configuration of the supporting base to the surface to be treated.

The invention in question is illustrated in its practical and exemplifying implementation, in the enclosed drawings is which:

DESCRIPTION OF THE PREFERRED EMBODIMENT AND DETAILED DESCRIPTION OF THE DRAWINGS

Figure 1:
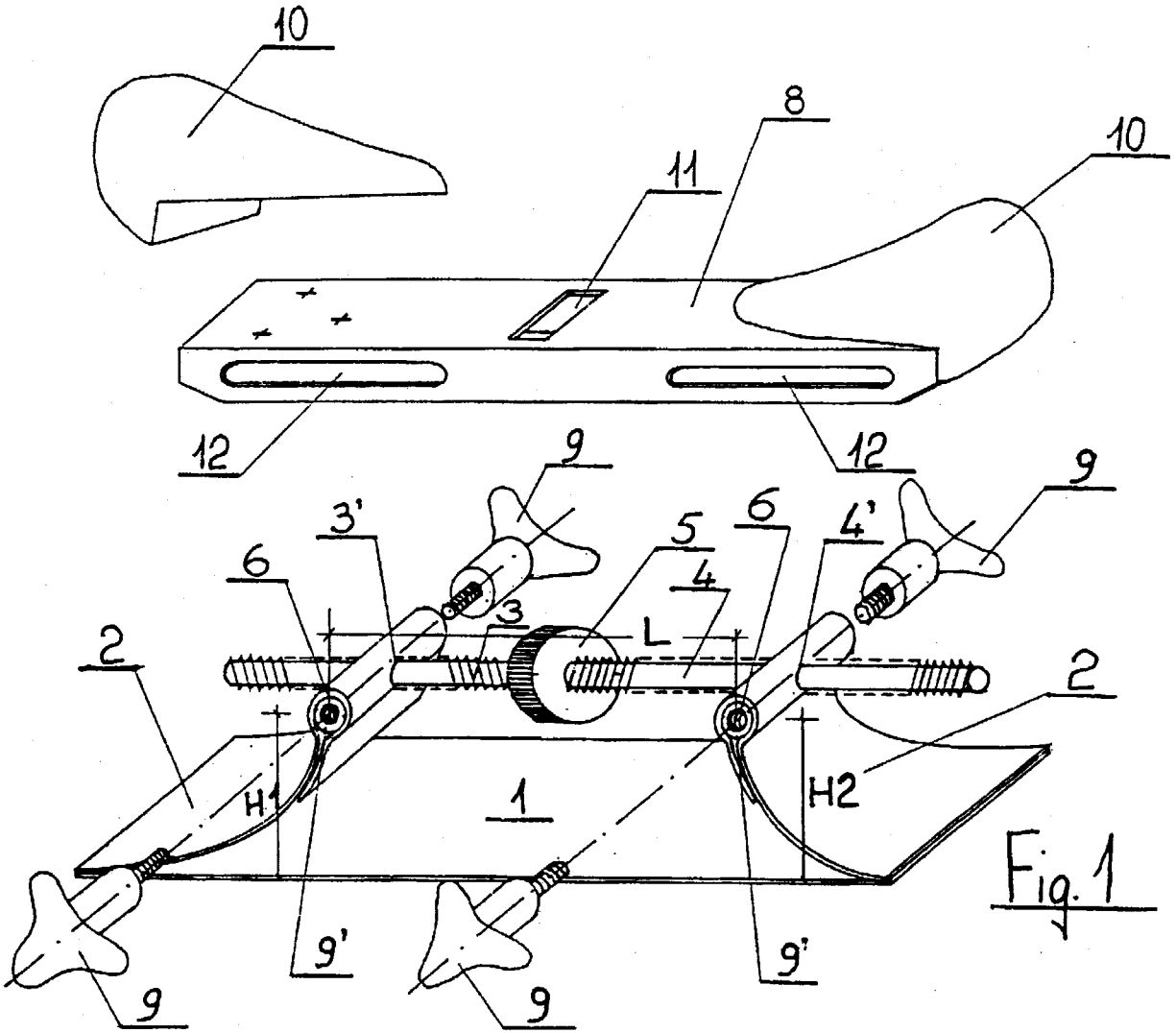
FIG. 1 show an exploded view of the tool subject matter of this invention.

With reference to these drawings, the supporting base 1 in elastic deformable plate material has usually a rectangular shape, its shorter sides are deemed to be the transverse legs while the longer sides are deemed to be the longitudinal legs of the rectangle. Two interconnecting elements 2 in indeformable material or plates having a low deformability are slanting upwards and their lower end is rigidly secured to the transverse legs of the supporting base 1. A rotating cross journal 6 is fitted to the upper end of each interconnecting element 2 and these cross journals 6 are provided with threaded borings 9' having a transverse screw axis and with a central threaded through-hole 3', 4' having a longitudinal axis. The longitudinal central borings 3', 4' have opposed left-hand and right-hand threads.

A longitudinal screw 3, 4, one half of which is lefthand and the other half is righthand threaded, meshes with the central threads 3',4' of the journals 6, the threads 3',4' being separated by a small knurled control wheel 5.

A guide 8 supporting the handgrips 10 usually having an upside-down U-shape, features a central hole 11 through which the small wheel 5 protrudes and four lateral slots 12, through which to introduce the tightening screws 9 into the borings 9' of the cross journals 6. These tightening screws 9 are used to block or release the supporting guide 8 on the tool after the configuration of the supporting base 1 has been finalized, as will be explained hereinafter.

The stopper materials to be used for repair or recommissioning of the damaged or distorted surfaces are applied on the lower outer surface of the supporting base 1. Similarly, the abrasive surface to be used for finishing of the previously stoppered surfaces is also secured to the above mentioned lower outer surface.

The tool described above is utilized as follows: After the screws 9 blocking the guide 8 have been partially loosened, the longitudinal screw 3, 4, is rotated by means of the small control wheel 5 and this operation will move the journals 6 inwards towards the center or outwards. Shifting of the journals 6 will change the inclination of the two interconnecting elements 2 which, being rigidly connected to the supporting base 1, will cause its deformation according to need.

Figure 2:
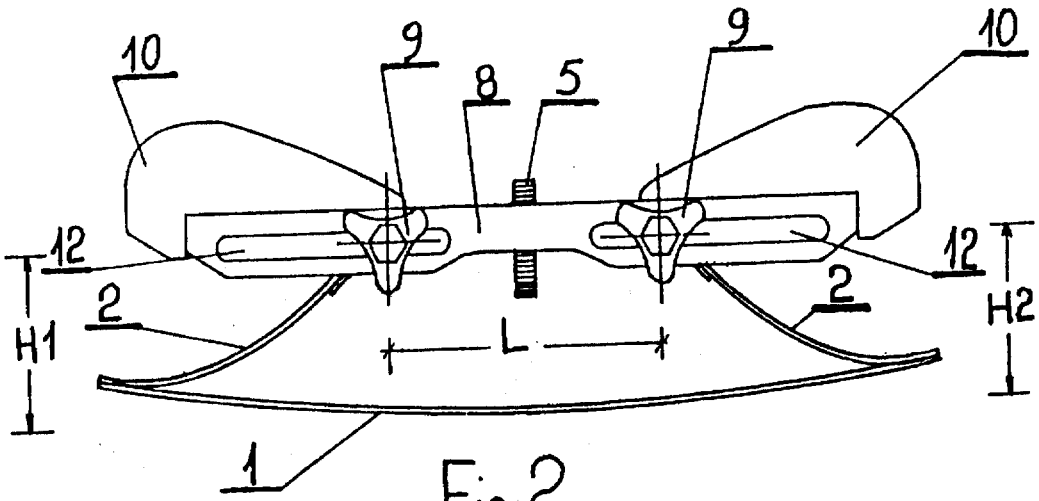
FIG. 2 shows a lateral view of the tool with its concave shaped supporting base and constant curvature (H1=H2)
Figure 3:
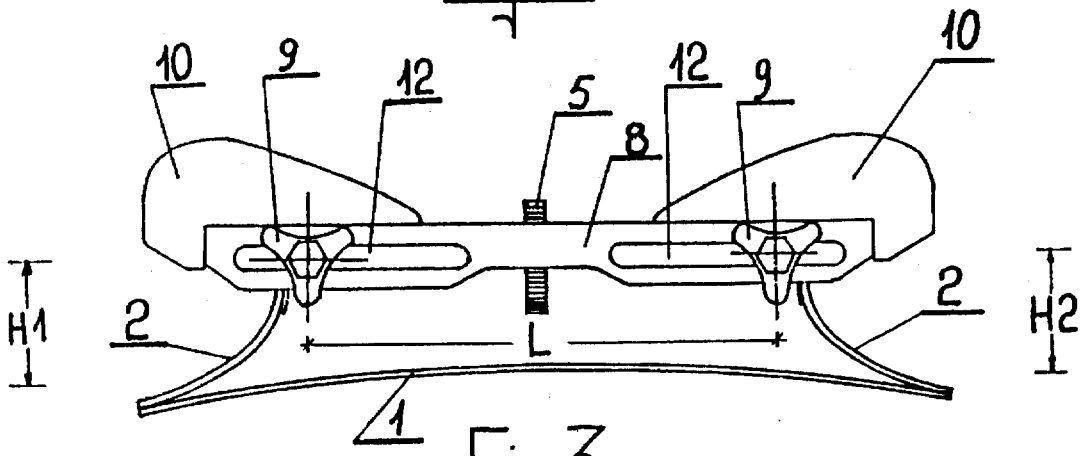
FIG. 3 shows a lateral view of the tool with its convex shaped supporting base having a constant curvature (H1=H2)
Figure 4:
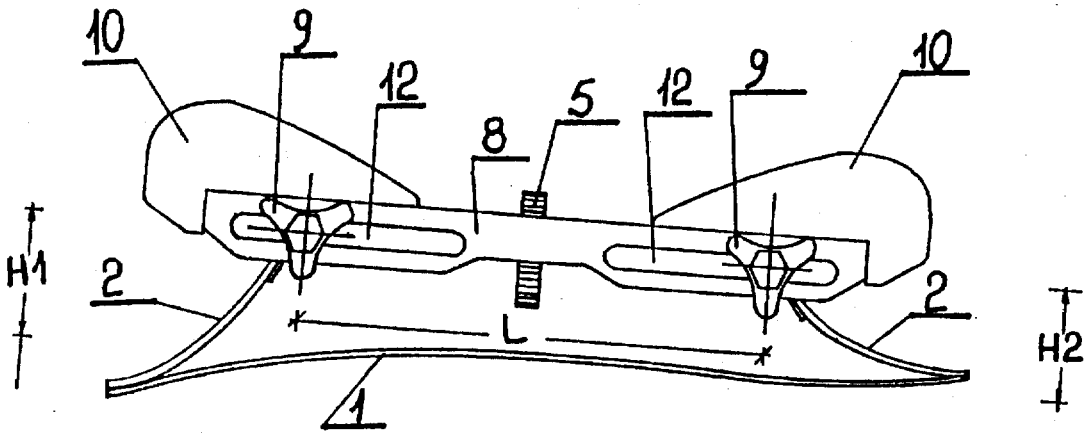
FIG. 4 shows a lateral view of the tool with its concave or convex shaped supporting base having a variable curvature (H1=H2).

In detail, the supporting base 1 will be flat when the cross journals 6 are centered in the slots 12; by moving the journals outwards, the supporting base 1 will become concave as shown in FIG. 2 and when moved inwards, the shape of the supporting base will be convex as shown in FIG. 3. If the height H1, H2 of the cross journals 6 is the same with respect to the supporting base 1, i.e. M=H1−H2=0, the bending radius of the supporting base 1 will be constant, i.e. it will have a cylindrical face. However, if H1 and H2 have different values and M=H1−H2≠, 0, the supporting base will have a variable concave or convex surface as shown in FIG. 4.

This height variation of H1, H2 is adjusted by hand by pressing on either end of the tool at different angulations of the interconnecting elements 2.

After the required shape of the supporting base 1 has been obtained, the screws 9 are tightened thus blocking the tool and locking the cross journals 6 stably to the support 8.

Finally, it is also possible to remove the longitudinal screws 3, 4, from the tool and to shape the supporting base 1 by placing it on the surface to be treated and tightening the screws 9.

This may be necessary when working on rather complex and multi-profile surfaces.

I claim:

1. Tool for stoppering and abrasion of concave and convex surfaces characterized in that it consists of:

a usually rectangular supporting base plate (1) in elastic deformable material, the short sides of which are deemed to be the transverse legs and the longer sides are deemed to be the longitudinal legs of the rectangle, two upwards slanting interconnecting elements (2) in plates having a low deformability index, their lower ends being rigidly secured to the transverse ends of the supporting base (1);

two rotating cross journals (6) each fixed to the upper end of the interconnecting elements (2), each journal (6) featuring at both ends threaded holes (9') as well as a s respectively right and left-handed threaded through-hole (3',4') drilled in the center of the journal (6), a screw (3,4,), half of which is left-threaded (3) and the other half is right-threaded (4) separated by a small control wheel (5) so that the threads (3,4) are meshing with corresponding central threads of the respective through-hole (3', 4') of the two cross journals (6), a guide (8) bearing the handgrip (10) usually having an upside-down U-shape, featuring a central hole (11) through which the control wheel (5) protrudes and lateral slots (12) through which to fit the screws (9) into the borings in the cross journals (6), thus blocking these journals (6) to the supporting guide (8).

2. Tool as described in claim 1, characterized in that the stopper materials as well as the abrasive surface are applied to the outer surface of the supporting base (1).

3. Tool as described in claim 1, characterized in that the supporting base (1) is strained according to the shape or profiles of the surfaces to be stoppered and abraded, by partially loosening the locking screws (9) of the cross journals (6) on the supporting guide (8) and by adjusting the small control wheel (5) and its screws (3,4) to change the distance (L) between the cross journals (6) or by manually adjusting the interconnecting elements (2) to change the height (H1,H2) of these journals (6) with respect to the supporting base (1), so that a variation of the distances (L) or (H1,H2) will bring the supporting base (1) in the desired shape, which will be maintained by tightening the locking screws (9) of the cross journals on the supporting guide (8).

4. Tool as described in claim 3, characterized in that to obtain a supporting base with a constant curved surface i.e. with a a circular cylindrical face, the heights (H1, H2) will be equal to M=(H1−H2)=0 simply by changing the distance (L) between the cross journals (6).

5. Tool as described in claim 3, characterized in that to obtain a supporting base with a variably curved surface, the heights (H1, H2) will be differentiated, with M=(H1−H2) ≠0.

6. Tool as described in claim 1, characterized in that the right-handed and left-handed threaded screws (3,4) may be removed and deformation of the supporting base (1) is manually achieved by blocking it with the utilization of the screws (9) linking the cross journals (6) to the guide (8).

* * * * *